US005806385A

United States Patent [19]

Schupp

[11] Patent Number: 5,806,385

[45] Date of Patent: Sep. 15, 1998

[54] UNIVERSAL SOCKET DEVICE

[75] Inventor: Andreas Schupp, Kowloon, Hong Kong

[73] Assignee: Continental Automotive Parts Center (H.K.) Ltd., Hong Kong, Hong Kong

[21] Appl. No.: 645,908

[22] Filed: May 14, 1996

[51] Int. Cl.[6] ..... B25B 13/58

[52] U.S. Cl. ..... 81/185; 81/DIG. 11; 81/442; 81/448

[58] Field of Search ..... 81/185, DIG. 11, 81/124.4, 437, 461, 442, 448; 269/266

[56] References Cited

U.S. PATENT DOCUMENTS

| | | | |
|---|---|---|---|
| 3,349,655 | 10/1967 | Locke | 81/185 |
| 3,698,267 | 10/1972 | Denney | 81/185 |
| 4,416,173 | 11/1983 | Rebish | 81/185 |
| 4,840,094 | 6/1989 | Macor | 81/185 |
| 4,887,498 | 12/1989 | Zayat | 81/185 |
| 5,460,064 | 10/1995 | Zayat, Jr. | 81/185 |

*Primary Examiner*—James G. Smith
*Assistant Examiner*—Joni Danganan
*Attorney, Agent, or Firm*—Oldham & Oldham Co., L.P.A.

[57] ABSTRACT

A universal socket is described which is suitable for use upon a myriad of fastening means whereupon at least a plurality of pins are capable of longitudinal axial movement in concert and in conformity with contact with a workpiece. This result is achieved by the incorporation of a biasing mechanism on the pins which biases the pins in a normally extended position, but which permits movement to a second retracted position. In one embodiment, the cross-sectional area of the pins is decreased in either a linear or non-linear manner from the outer periphery to the center of the socket. In operation, as the workpiece is inserted into the socket, the pins are moved in a longitudinal axial direction from their normally extended position to the second retracted position in conformity with the shape of the workpiece. Upon the application of a torque force to the closed end of the socket fitted with a drive means, the workpiece is either moved clockwise or counterclockwise depending upon the nature of the operation to be performed, i.e., tightening or loosening. Upon removal of the workpiece, the pins return to their original extended position due to the biasing mechanism, typically being a spring positioned around a reduced diameter uppermost end of the pins. In one configuration of the pins, accommodation is made for larger multi-sided workpieces than would normally be expected to be inserted into the socket based on the available surface area of the pins through the incorporation of triangular shaped free space within the socket adjacent to the pins. This permits larger sized 4- sided and 6-sided nuts and bolts to be effectively removed or tightened for example.

21 Claims, 4 Drawing Sheets

UNIVERSAL SOCKET DEVICE

TECHNICAL FIELD

The invention described herein pertains generally to socket tools, and in particular, to a universal socket which is operative for turning a plurality of different sized fastening elements, such as nuts, bolts, slotted screws, Phillips head screws, eye bolts, wing nuts, etc.

BACKGROUND OF THE INVENTION

Universal socket tools are known in the art. U.S. Pat. No. 4,887,498 represents one such tool. The '498 patent discloses a universal socket tool comprising a housing forming a chamber having an open lower end, and a large bundle of small, square individual pins suspended longitudinally within the chamber by a plurality of side-by-side rails. All of the pins have similar dimensions, and are placed in side by side relationship with one another. The lower ends of the pins are adapted for engaging various fastening elements when the lower ends of the pins are pressed downwardly over the fastening element. The pins are suspended such that when the lower end of the pins engage a fastening element, the engaged pins are forced to slide upwardly into the chamber. A highly complex spring assembly is provided for returning the pins to their original position after pressured engagement with the fastening element is removed. The large number of small pins and complicated spring assembly make the device extremely difficult to assemble and expensive to manufacture. Additionally, the tool may not function well with all types of fastening elements, as the shape of the pins may not allow positive engagement with a fastening element. The square pins or a pin configuration having flat sides and right angle corners also tend to inhibit relative movement between adjacent pins due to the large frictionally engaged surface area between adjacent pins.

U.S. Pat. No. 5,460,064 represents another embodiment of a universal socket tool. It comprises a rectangular housing having a longitudinal chamber with an open lower end. Again, the tool uses an array of square pins which are longitudinally oriented in the chamber wherein the lower ends of the pins are flush with the open end of the chamber and are adapted for engagement with a fastening element. A selected group of side-by-side pins have tapered end portions which are operative for engagement with a slotted or Phillips head screw. The pins as described in this patent are suspended in the chamber in adjacent relationship wherein engagement of the lower ends of the pins with a fastening element forces the engaged pins upwardly into the chamber. The suspension system includes upper and lower suspension plates which are mounted in closely spaced parallel relation in the chamber and secured in fixed engagement in the chamber. The upper and lower suspension plates have aligned apertures for slidably receiving the pins. Each of the pins is further provided with a coil spring disposed around its upper end for returning the pins to their normal position after pressured engagement with a fastening element is terminated. In another embodiment, the suspension system comprises a plurality of side-by-side retainer elements each having a plurality of downwardly extending mounting heads, and further comprises a plurality of springs each having a first end secured to the upper end of a corresponding pin and a second end received over a mounting head on a corresponding retainer element. The suspension system was additionally described to comprise an adhesive medium within the chamber instead of the mounting heads. The invention described in this patent may also be susceptible to the problems noted with respect to U.S. Pat. No. 4,887,498.

However, while the art of universal sockets has been advanced, the above configurations are still complicated and difficult to manufacture. The prior art devices similarly do not provide tools which operate effectively over an extended period, or provide the desired functioning with the number of different fastening elements encountered. The prior art similarly does not allow the effective ability to repair the device should individual pins be damaged for example. The need therefore still exists for an improved universal socket.

SUMMARY OF THE INVENTION

In accordance with the present invention, there is provided a universal socket which is suitable for use upon a myriad of fastening means whereupon at least a plurality of pins are capable of longitudinal axial movement in concert and in conformity with contact with a workpiece. This result is achieved by the incorporation of a biasing means on the pins which biases the pins to a normally extended position, but which permits movement to a second retracted position. In one embodiment, the cross-sectional area of the pins is decreased in either a linear or non-linear manner from the outer periphery to the center of the socket.

In operation, as the workpiece is inserted into the socket, the pins are moved in a longitudinal axial direction from their normally extended position to a second retracted position in conformity with the shape of the workpiece. Upon the application of a torque force to the closed end of the socket fitted with a drive mechanism, the workpiece is either moved clockwise or counterclockwise depending upon the nature of the operation to be performed, i.e., tightening or loosening. Upon removal of the workpiece, the pins return to their original extended position due to the biasing means, typically a spring positioned around a reduced diameter uppermost end of the pins.

In one configuration of the pins, accommodation is made for larger multi-sided screws than would normally be expected to be inserted into the socket based on the available surface area of the pins through the incorporation of triangular shaped free space within the socket adjacent to the pins. This permits larger sized 4-sided and 6-sided nuts and bolts to be effectively removed or tightened.

The invention also preferably includes pins which have a predetermined cross-sectional configuration which facilitates slidable movement between adjacent pins while effectively engaging a workpiece. The invention further provides in the preferred embodiment, a selectively removable subassembly of the plurality of pins which would allow replacement of the pin configuration for different applications or repair of components of the subassembly.

It is an object of this invention to provide a universal socket which is easy to use and accommodates various sized workpieces without the need for a unique sized socket, and which can be manufactured and maintained cost effectively.

These and other objects of this invention will be evident when viewed in light of the drawings, detailed description, and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
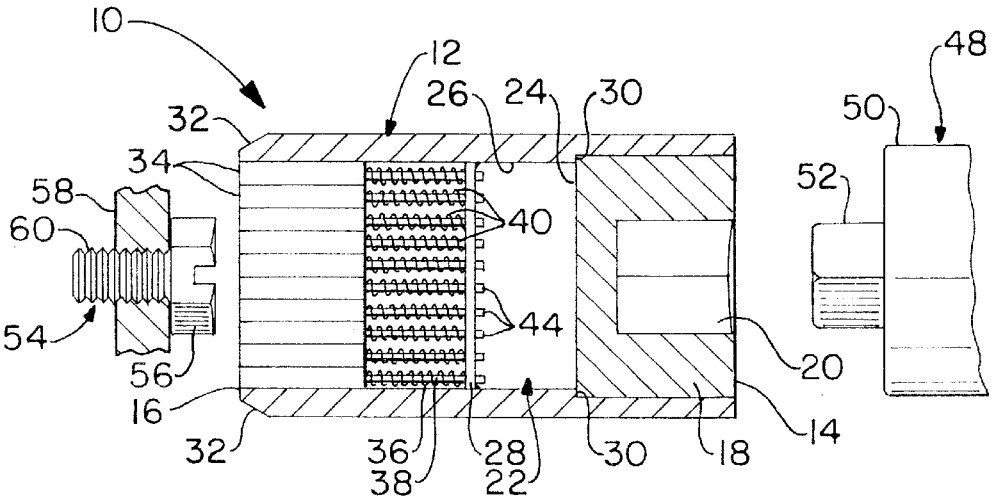
FIG. 1 is a side view of the universal socket shown in partial cross-section.
Figure 2:
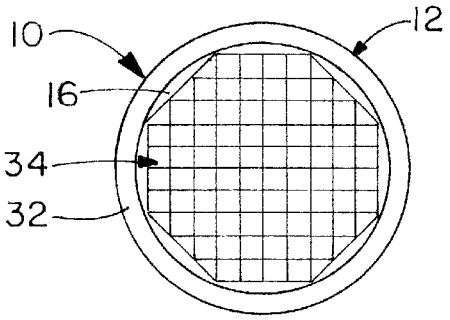
FIG. 2 is a bottom view of the socket showing one geometric arrangement of the pins.
Figure 3:
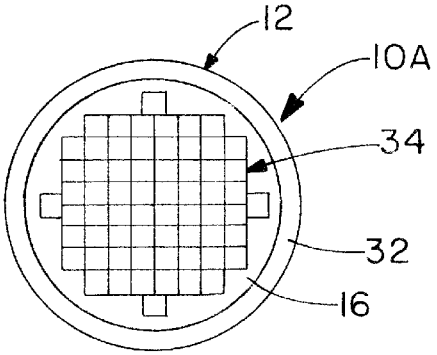
FIG. 3 is a bottom view of the socket showing another geometric arrangement of the pins.

Referring now to the drawings which are for purposes of illustrating the preferred embodiments of the invention only and not for purposes of limiting the same. The Figures show an improved universal socket which overcomes many of the prior art deficiencies.

The best mode for carrying out the invention will now be described for the purposes of illustrating the best mode known to the applicant at the time. The examples are illustrative only and not meant to limit the invention, as measured by the scope and spirit of the claims.

Shown in FIG. 1, is a universal socket 10 for use with a socket wrench or other driving mechanism, for which the drive component 48 is partially illustrated. The socket comprises a housing 12 with a substantially closed top 14 with a drive recess 20 within the head portion 18 of the housing which accommodates a drive lug 52 on the head 50 of a drive member 48. A lowermost portion 16, typically having beveled edge 32 about its periphery, has an open end into which of a plurality of side-by-side spring- loaded 36 retractable pins 34 are positioned. The pins 34 are capable of being displaced from a first extended position to a second retracted position by communication with and accommodation of a workpiece 54. While the socket is shown as tubular, there is no inherent reason to limit the configuration to this circular arrangement, and other geometric shapes are envisioned, such as n-sided polygons, wherein n is at least three. It is recognized that as the integer value of n increases, the shape of the socket will approach that of a circle.

The pins 34 are positioned within an internal chamber 22 of the socket by a pin positioning mechanism 28 in communication with the housing 12 and retained within the housing by a pin retaining means 44. The pin positioning mechanism 28 serves not only to support the pins without housing 12, but also defines the longitudinal movement of the pins 34 within chamber 22. This inner chamber is sized at its upper end 24 to accommodate the upper portion 38 of the pin 34 when in its fully retracted position caused by the longitudinal axial movement of the pin due to its contact with the workpiece 54.

As seen in FIG. 1, the workpiece 54 is shown fastened into a surface member 58, such as a threaded 60 bolt with a multi-sided head 56. There are no limitations as to the configuration of the workpiece which can be effectively either inserted or removed using the tool of this invention other than the consideration that the diameter of the workpiece must fit within the internal area defined by the housing 12 adjacent the external edges of outer pins 34. The socket is effective for inserting or removing lag bolts or screws which have an essentially circular head configuration and into which various geometric shapes have been made in the head, e.g., slots, crosses (Phillips), star-shapes, squares (Allen), etc., or in tightening or loosening nuts which may be attached to screws or bolts.

Figure 4:
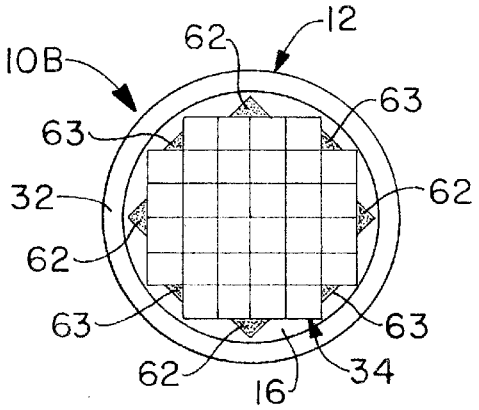
FIG. 4 is a bottom view of the socket showing yet another geometric arrangement of the pins with expansion slots.
Figure 2A:
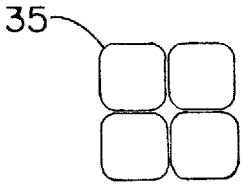
FIG. 2*a* is a bottom view of four pins showing their geometric configuration.
Figure 4A:
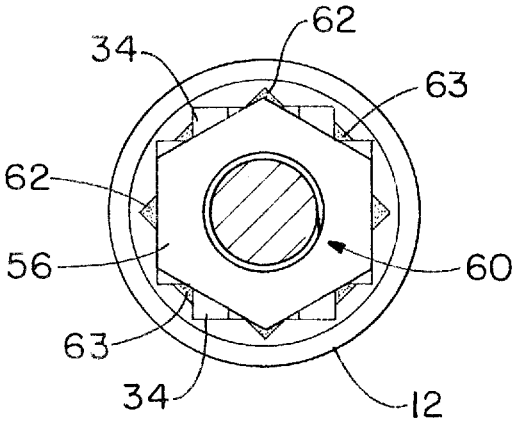
FIGS. 4*a* and 4*b* show bottom views of the embodiment shown in FIG. 4, showing a bolt head fitting therein in different orientations.
Figure 4B:
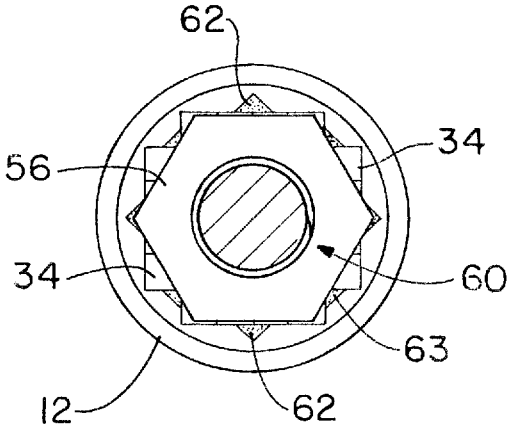

As illustrated in FIGS. 2–5, the arrangement of the pins 34 is varied in the preferred embodiments of the invention in terms of actual geometric arrangement. In general, the pins 34 according to the preferred embodiment will be formed as essentially a regular polygon in cross-section to minimize twisting of the pins in the housing 12 upon the application of a torque force to the socket. Although formed generally as a regular polygon, the pins 34 also preferably have each corner of the polygon shape rounded or tapered with respect to adjacent sides thereof as shown in FIG. 2*a* at 35. This particular configuration of the pins 34 minimizes the actual frictional engagement between adjacent pins within the housing 12, so as to facilitate relative slidable movement between adjacent pins. It has been found in prior art approaches that frictional engagement between adjacent pins may inhibit slidable movement between pins, particularly after an extended time or extensive use. The corners 35 configured in this manner allow significantly improved relative slidable movement between pins, such that the age of the device or the extent which it is used will not hinder proper performance thereof in operation. Providing the corner configuration 35 as shown in FIG. 2*a* produces interstitial gaps between pins 34, which although not hindering effective coupling to the workpiece, allow the pins 34 to move more easily relative to one another. The gaps between pins 34 at the corner areas 35 also allow a lubricant to be applied to the pins 34 so as to further reduce frictional engagement therebetween, with the reapplication of lubricant providing better dispersion throughout the pin surfaces. Further, the actual geometric pattern of pins within the chamber 22 of housing 12 can be arranged so as to accommodate larger or smaller workpieces and is a function of both design and strength considerations, correlating directly to the proportion of pin space and non-pin space 16. In one particular arrangement shown in FIG. 4, the non-pin space is further divided into free space 62,63 designed to increase the size of the nut which can be accommodated by the arrangement shown for example, in FIG. 2. This free space can now be effectively used to accommodate larger sized multi-sided nuts or bolts by utilization of the free space designated by 62 or 63. For example, the configuration of housing 12, and particularly chamber 22 may accommodate larger sized 6-sided nuts or bolts by utilization of the free space designated by 63 such as shown in FIGS. 4a and 4b. In FIGS. 4*a* and 4*b*, a bolt 60 having a head 56 is shown in fitting relationship with the internal area of chamber 22 in different orientations. It is noted that the spaces 62 and/or 63 accommodate corners or sides of the multi-sided head 56. The internal surfaces of chamber 22 will therefore accommodate a maximum sized workpiece, with the internal surfaces themselves engaging the workpiece 54. The shape of the chamber 22, such as shown in FIG. 4 or in other predetermined configurations is thus configured to accommodate certain sizes and types of workpieces 54 which otherwise would be too big to be operated on by the tool 10.

Figure 5:
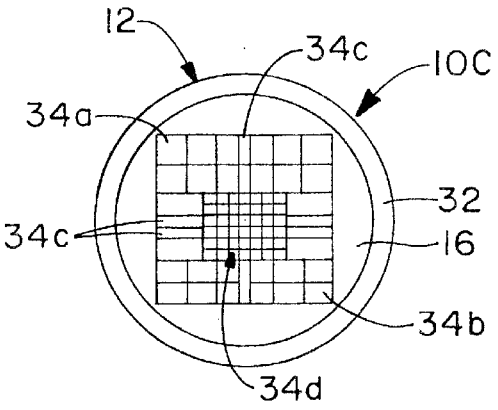
FIG. 5 is a bottom view of the socket showing yet another geometric arrangement of the pins.

In another configuration of the pins 34 shown in FIG. 5, the cross-sectional area of the pins varies in both the x and y directions. In this embodiment, the cross-sectional area of the pins 34 decreases from an outer pin shown at 34 to an inner pin designated 34*d*. The rate of variation of the x or of the y dimension does not need to be uniform for both of the dimensions, as shown in the Figure by the representation of two pins designated 34*c* in the y direction and the designation of only one pin designated 34*c* in the x direction. The varying cross-sectional area of the pins 34 makes it possible to configure certain pins to accommodate a slotted configuration in the top of a workpiece with which the tool 10 is to be used. As an example, if tool 10 is to be used to remove a screw or similar type of workpiece, having a circular or rounded head and slot configuration in the head for engagement by a drive mechanism. With such a workpiece, the provision of varying size pins 34 as shown in FIG. 5 allows any slotted head configuration to be engaged by a relatively large number of pins 34 to allow driving of the workpiece by means of tool 10. When using this arrangement, it is possible to maximize the torque which can be applied to any slotted workpiece which is centered within the socket in that the greatest number of pins 34 will be positioned at the center of the socket where the slotted workpiece is positioned. Along with varying the size of pins 34, the shape of pins 34 may also be varied if desired, such as providing circular or other shaped pins which vary in size or are used in conjunction with other shaped pins 34.

Figure 6:
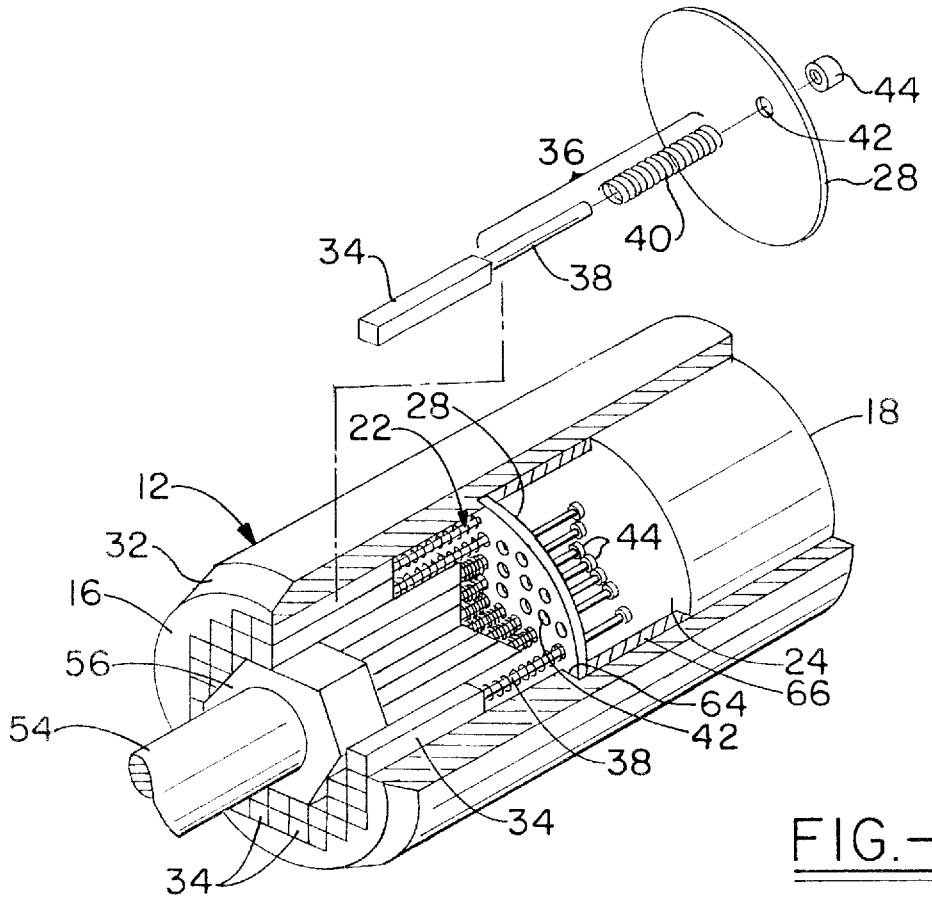
FIG. 6 is a perspective view shown in partial cross-section showing the socket inserted onto a workpiece and additionally showing an expanded view of a spring-loaded pin.
Figure 7:
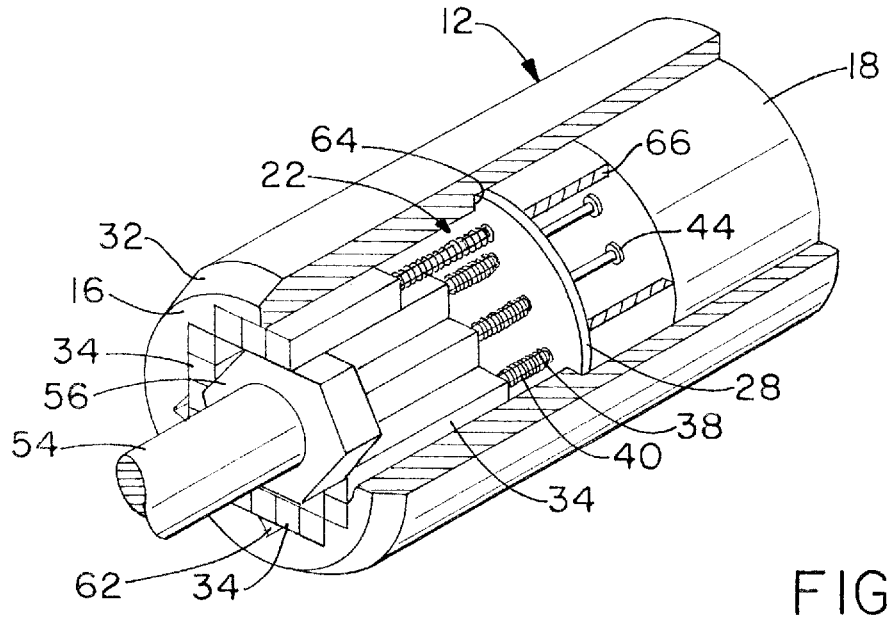
FIG. 7 is a perspective view shown in partial cross-section showing the socket inserted onto a workpiece and additionally showing the workpiece fitted into an expansion slot.

As seen with reference to FIGS. 1 and 6–7, the pins 34 are positioned within the chamber 12 such that their upper ends 36 are suspended by a pin positioning mechanism 28 within the chamber such that the individual pins 34 are free for upward retraction into the upper part of the chamber 22 when the lower end surfaces of the pins are contacted by a workpiece 54. The pin positioning mechanism 28 preferably comprises a plate member having a plurality of spaced-apart apertures 42 through which pins 34 pass. The pins 34 preferably include an uppermost circular end 38 which passes through the apertures 42 to be disposed within the uppermost portion of chamber 22. On each of the ends 38 of pins 34, a pin retaining mechanism 44 is provided, to maintain the ends 38 of pins 34 on the opposite side of the pin positioning plate 28 from the lowermost ends thereof The pin retaining mechanism 44 may be a rivet head or other suitable stopper which can easily be secured to the ends 38 of pins 34 to retain the pins 34 in association with positioning mechanism 28. The portion of pins 34 which extend through the apertures 42 may be of reduced diameter portion as compared to the lowermost portion of pins 34, but this portion of the pins 34 does not require an integral enlarged head portion to maintain their relationship with the positioning plate 28 which would require increased manufacturing complexity and cost. In association with each of the pins 34, and situated between the lowermost portion and the positioning mechanism 28, is a biasing means 40, e.g., a spring, is provided. The preferably narrowed portion of the pins 34 are positioned within the housing such that an individual biasing means 40 may be inserted therearound such that the uppermost end of the reduced diameter portion of the pin 38 will extend through one of the openings 42 with the spring 40 engaging plate 28. In this manner, the biasing means will engage the base portion of the pin positioning mechanism 28 such that as the pins are forced upwardly as by engagement of a workpiece to be turned, then such action will compress the biasing means 40 to a degree dependent on the size of the workpiece. When the twisting or turning action is completed, the springs 40 will force the pins 34 back to their original position. While in general the lowermost terminal surface of the pins is coextensive with the lowermost portion of the socket, there is no inherent reason to limit the design to such. Longer pins extending beyond the lowermost portion of the socket are envisioned as part of this invention and in some instances may be highly desirable, such as for example, when a nut is positioned within a recessed location into which the socket will not fit, but into which the pins may extend.

The pin positioning mechanism is typically a circular disk which conforms to the geometric shape of the chamber 22 of housing 12. In an embodiment, the tool 10 allows the user to selectively remove the subassembly comprised of the pins 34 and the associated components being the biasing members 40 and positioning mechanism 28. In some situations, an individual or multiple pins 34 may be damaged by use of the tool, and it would be desirable to replace such pins without replacing the entire tool 10. By enabling the subassembly as mentioned to be selectively removed from the lowermost portion 16 of the housing 12, the individual pins 34 which may have been damaged could be replaced in a simple and effective manner. Once such pins 34 are repaired, the subassembly can be reinserted into the housing 12 for subsequent use of tool 10. Alternatively, as a variety of pin configurations are embodied within the present invention, it may be desirable to utilize a particular pin configuration for a particular application. The present invention allows selective removal of the subassembly comprising the pins 34, springs 40 and positioning plate 28 from the housing, 12, for replacement via similar subassembly using a different pin configuration. The provision of selectively allowing the pin configuration to be varied or modified greatly enhances the flexibility of use of the tool 10 for a variety of different applications. In such an embodiment, the positioning plate 28 is configured in a predetermined manner in association with the housing 12 or interior of chamber 22 thereof, to facilitate the selective positioning or removal of the subassembly therefrom. A preferred way of attaching the pin positioning mechanism 28 into the housing 12 is shown in FIGS. 6–7. A shelf 64 may be formed within the housing 12 to "inhibit" longitudinal movement of the pin positioning mechanism toward the bottom or open end of housing 12. The pin positioning mechanism 28 may include a peripheral band or sleeve portion 66, positioned to extend along at least a portion of the periphery of the chamber 22 and extending toward the uppermost end of chamber 22. The sleeve 66 is preferably configured to exert an outwardly directed force against the sidewalls of chamber 22 to retain the positioning plate 28 and entire subassembly in a predetermined position, while allowing selective longitudinal movement thereof within chamber 22. As an example, the sleeve 66 may be integral with the plate 28, extending toward the lowermost portion of chamber 22 and having at least a portion thereof dimensioned to extend to the top edge of chamber 22 to limit the extent to which the sleeve 66 may be inserted within chamber 22. The sleeve 66 may be configured as a continuous sleeve which conforms to the interior shape of chamber 22, or may have a series or plurality of individual segments which cooperate with particular interior surfaces of chamber 22. In either embodiment, the sleeve 66 is preferably designed as having a slightly outwardly tapering configuration, but is constructed of a material which is resilient, allowing a degree of deflection of the sleeve relative to the walls of chamber 22. The slight outward taper of sleeve 66 provides a biasing force on the sidewalls of chamber 22 when the sleeve is positioned therein, inhibiting slidable movement of sleeve 66 relative to chamber 22. Again, the shelf 64 may also facilitate inhibiting longitudinal movement of the plate 28 and associated sleeve 66 within chamber 22. At the same time, the resiliency of the sleeve 66 allows application of a force to the plate 28 which will cause longitudinal movement of the entire subassembly, when the frictional engagement between the sleeve 66 and/or plate 28 is overcome. Thus, the subassembly may not be permanently secured within the housing 12, but is selectively removable for repair or replacement in the desired manner. This construction serves to anchor the pin positioning mechanism 28 within the housing 12, the band abutting the bottom of the head portion 18 of the housing. Alternatively, if the ability to selectively remove the subassembly is not desired, the pin positioning mechanism 28 can be retained in position via welding or other fastening means to the side walls of the housing 12 within chamber 22.

In operation, socket 10 is positioned above a bolt head 56 such that the lower edge of the housing rests on the workpiece head 56 or is proximal thereto and the lower ends of the pins 34 contact the head 56. With such contact, the pins 34 are free to reciprocate up into the chamber 22 to accordingly accommodate the form of the bolt head such that engaging drive contact with the inner edges of the pins 34 which have been displaced and the outer surfaces of the bolt head is accomplished in the intended manner. Thereafter, the housing need only be rotated vis-a-vis the bolt head such that it is either tightened or loosened in the intended manner. Such rotation may be accomplished by the drive component 48 or other appropriate means.

Figure 8:
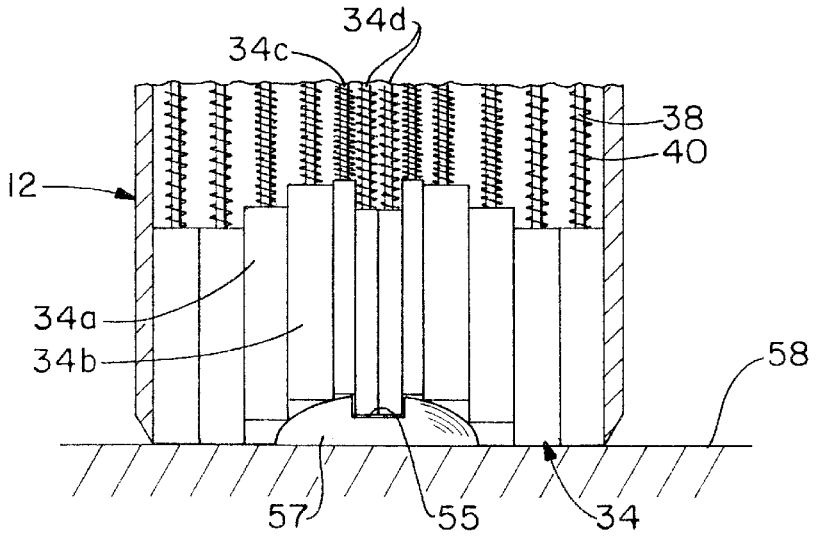
FIG. 8 shows a manner in which a pin or pins may be displaced to accommodate the recessed slotted head of a screw member.
Figure 9:
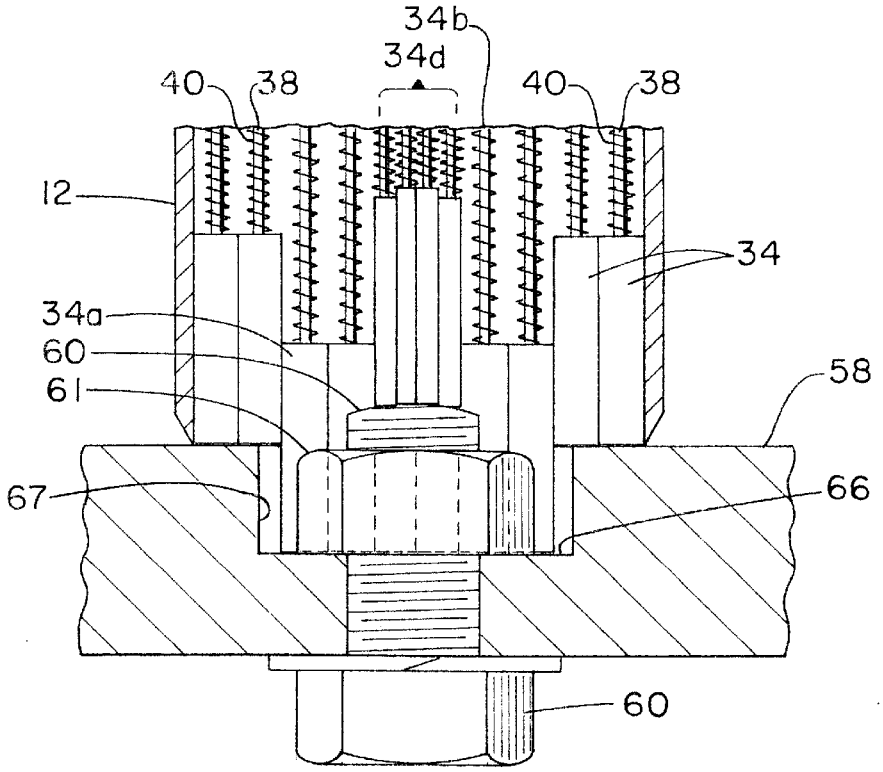
FIG. 9 shows a view similar to FIG. 8 but showing the manner in which pins may accommodate a recessed hex nut.

In FIG. 8, a workpiece having a rounded head 57 is shown flush against a surface 58. The outwardly projecting screw head 57 includes a recessed drive slot 55. In such case, an aligned group of pins 34d is adapted to extend downwardly into the recess or slot 55 to form a drive connection therewith, and the laterally adjacent pins adapted to extend upwardly into the chamber 22 to accommodate the remaining shape of the screw head. In a preferred mode, the pin configuration shown in FIG. 5 is used which through its myriad of cross-sectional areas of the pins, will maximize the chance of at least one, and preferably a plurality of pins locating the slot of the screw head, and thereby facilitating the insertion or removal of the screw. Similarly, in FIG. 9, the surface 58 is provided with a recess 67 which includes a derivable component such as a hex nut 61 and its upwardly projecting threaded bolt 60. In such case, the pins are free to extend downwardly to accommodate the upper surfaces of the nut 61 and projecting threaded bolt 60.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A socket tool for removing and tightening workpieces, comprising, a housing having an open end and a substantially closed end, said housing forming an interior chamber having a first open end and a second closed end, a plurality of slidable pins positioned in said chamber and extending longitudinally from said first end toward said second end thereof, each of said plurality of pins having a first end positioned adjacent said open end of said chamber, and a second end positioned within said chamber, wherein said second end is movably secured within a pin positioning member within said chamber, and wherein each of said plurality of pins including a biasing member acting to bias each of said pins to a first position, said pin positioning member having a plurality of apertures through which a portion of each of said plurality of pins passes, and having stopper means at said second end of said pins to movably retain said pins in association with said pin positioning member, said plurality of pins being capable of longitudinal axial movement from a first extended position to a second retracted position in response to contact with a workpiece, and wherein said pin positioning member includes a sleeve portion in association therewith which extends along the longitudinal direction of said chamber, said sleeve portion movably retaining said pin positioning member within said chamber.

2. The tool of claim 1, wherein said plurality of pins vary in cross-sectional configuration within said chamber.

3. The tool of claim 2, wherein said plurality of pins include outermost pins positioned adjacent the periphery of said chamber, and innermost pins positioned about the longitudinal axis of said housing, wherein the size of said pins varies from a larger cross-sectional configuration at the outermost pins toward a smaller cross-sectional configuration at the innermost pins.

4. The tool of claim 1, wherein, each of said plurality of pins has a cross-sectional configuration of a regular polygon, with each of the corners of said regular polygon being curved, such that adjacent pins within said chamber will contact one another only over a limited surface area, and voids will be present at the corners of each of said pins.

5. The tool of claim 1, wherein said plurality of pins have a non-uniform cross-sectional area.

6. The tool of claim 1, wherein said housing further comprises a plurality of open spaces adjacent to said plurality of pins, with the interior surfaces of said housing conforming to a predetermined shape of a workpiece.

7. The tool of claim 1, wherein said sleeve member is dimensioned so as to contact the closed end of said chamber and position said pin positioning member at a predetermined location within said chamber.

8. The tool of claim 1, wherein said sleeve portion applies an outwardly directed biasing force on at least one wall of said interior chamber.

9. The tool of claim 1, wherein said housing includes a shelf portion formed within said chamber, which selectively supports said pin positioning member in a desired position within said chamber.

10. The tool of claim 1, wherein said pin positioning member applies an outwardly directed biasing force on at least one wall of said interior chamber to inhibit movement of said pin positioning member in said chamber.

11. A universal socket comprising:

a housing having an open end and a substantially closed end with an aperture for insertion of a drive mechanism;

a pin positioning mechanism within said housing having a plurality of apertures disposed therein, which is movably positioned within said housing;

a plurality of pins disposed within said housing which are capable of longitudinal axial movement from a first extended position to a second retracted position in response to contact with a workpiece;

wherein each pin has a pin biasing mechanism for maintaining the pin in the first extended position, and wherein the open end of the housing further comprises at least four triangular openings adjacent to the pins.

12. The universal socket of claim 11 wherein the uppermost portion of the pins has a pin retaining portion which engages said pin positioning member to maintain said pins in association therewith.

13. The universal socket of claim 11 wherein the pins have a non-uniform cross- sectional area.

14. The universal socket of claim 13 wherein the cross-sectional area of the pins decreases from the exterior periphery to an internal section of the pins.

15. The tool of claim 11, wherein said pin positioning mechanism applies an outwardly directed biasing force on at least one interior wall of said housing to inhibit movement of said pin positioning mechanism in said chamber.

16. The tool of claim 11, wherein said pin positioning mechanism includes a sleeve portion in association therewith which extends along the longitudinal direction of the interior of said housing, said sleeve portion movably retaining said pin positioning mechanism within said housing, and wherein said sleeve portion applies an outwardly directed biasing force on at least one interior wall of said housing.

17. A socket tool for removing and tightening workpieces, comprising:

a housing having an open end and a substantially closed end, said housing forming an interior chamber having a first open end and a second closed end;

a plurality of slidable pins positioned in said chamber and extending longitudinally from said first end toward said second end thereof;

each of said plurality of pins having a first end positioned adjacent said open end of said chamber, and a second end positioned within said chamber, wherein said second end is movably secured within a pin positioning member within said chamber, and wherein each of said plurality of pins includes a biasing member acting, to bias each of said pins to a first position;

said pin positioning member having a plurality of apertures through which a portion of each of said plurality of pins passes, and having a stopper means at -.aid second end of said pins to movably retain said pins in association with said pin positioning member wherein said pin positioning member is movably retained in said interior chamber; and said plurality of pins being capable of longitudinal axial movement from a first extended position to a second retracted position in response to contact with a workpiece, wherein said stopper means comprises separate stoppers secured to the second end of said pins.

18. A socket tool for removing and tightening workpieces, comprising:

a housing having an open end and a substantially closed end, said housing forming an interior chamber having a first open end and a second substantially closed end;

a plurality of slidable pins positioned in said chamber and extending longitudinally from said first end toward said second end thereof, each of said plurality of pins having a first end positioned adjacent said open end of said chamber, and a second end positioned within said chamber, wherein said second end is movably secured within a pin positioning member within said chamber, and wherein each of said plurality of pins includes a biasing member acting to bias each of said pins to a first position;

said pin positioning member having a plurality of apertures through which a portion of each of said plurality of pins passes, and having stopper means at said second end of said pins to movably retain said pins in association with said pin positioning member;

said plurality of pins being capable of longitudinal axial movement from a first extended position to a second retracted position in response to contact with a workpiece, wherein said plurality of pins vary in cross-sectional configuration within said chamber, and wherein said plurality of pins included outermost pins positioned adjacent the periphery of said chamber, and innermost pins positioned about the longitudinal axis of said housing, wherein the size of said pins varies from a larger cross-sectional configuration at the outermost pins toward a smaller cross-sectional configuration at the innermost pins.

19. A socket tool for removing and tightening workpieces, comprising:

a housing having an open end and a substantially closed end, said housing forming an interior chamber having a first open end and a second closed end;

a plurality of slidable pins positioned in said chamber and extending longitudinally from said first end toward said second end;

each of said plurality of pins having a first end positioned adjacent said open end of said chamber, and a second end positioned within said chamber, wherein said second end is movably secured within a pin positioning member within said chamber, and wherein each of said plurality of pins includes a biasing member acting to bias each of said pins to a first position;

said pin positioning member having a plurality of apertures through which a portion of each of said plurality of pins passes, and having a stopper means at said second end of said pins to movably retain said pins in association with said pin positioning member; and said plurality of pins being capable of longitudinal axial movement from a first extended position to a second retracted position in response to contact with a workpiece, wherein each of said plurality of pins has a cross-sectional configuration of a regular polygon, with each of the corners of said regular polygon being curved, such that adjacent pins within said chamber will contact one another only over a limited surface area, and voids will be present at the corners of each of said pins.

20. A universal socket comprising:

a housing having an open end and a substantially closed end with an aperture for insertion of a drive mechanism;

a pin positioning mechanism within said housing having a plurality of apertures disposed therein, which is movably positioned within said housing;

a plurality of pins disposed within said housing which are capable of longitudinal axial movement from a first extended position to a second retracted position in response to contact with a workpiece;

wherein each pin has a pin biasing mechanism for maintaining the pin in the first extended position;

wherein the pins have a non-uniform cross-sectional area;

wherein the cross-sectional area of the pins decreases from the exterior periphery to an internal section of the pins.

21. A universal socket comprising:

a housing having an open end and a substantially closed end with an aperture for insertion of a drive mechanism;

a pin positioning mechanism within said housing having a plurality of apertures disposed therein, which is movably positioned within said housing;

a plurality of pins disposed within said housing which are capable of longitudinal axial movement from a first extended position to a second retracted position in response to contact with a workpiece;

wherein each pin has a pin biasing mechanism for maintaining the pin in the first extended position; and wherein said pin positioning mechanism includes a sleeve portion in association therewith which extends along the longitudinal direction of the interior of said housing, said sleeve portion movably retaining said pin positioning mechanism within said housing, and wherein said sleeve portion applies an outwardly directed biasing force on at least one interior wall of said housing.

* * * * *